US005701892A

United States Patent [19]

Bledstein

[11] Patent Number: 5,701,892

[45] Date of Patent: Dec. 30, 1997

[54] MULTIPURPOSE FACE MASK THAT MAINTAINS AN AIRSPACE BETWEEN THE MASK AND THE WEARER'S FACE

[76] Inventor: Adrien Janis Bledstein, 5459 S. Hyde Park Blvd., Chicago, Ill. 60615-5801

[21] Appl. No.: 565,964

[22] Filed: Dec. 1, 1995

[51] Int. Cl.[6] ..... A62B 7/10; A62B 18/08; A62B 23/02

[52] U.S. Cl. ..... 128/206.19; 128/206.16

[58] Field of Search ..... 128/201.13, 201.15, 128/201.17, 206.12–206.16, 206.19; 2/9, 424, 173, 206, 255, 256

[56] References Cited

U.S. PATENT DOCUMENTS

| | | | |
|---|---|---|---|
| D. 205,332 | 7/1966 | Nelson | 128/206.12 |
| 2,007,867 | 7/1935 | Le Duc | 128/206.12 |
| 2,039,681 | 5/1936 | Chatfield | 128/206.19 |
| 2,070,754 | 2/1937 | Schwartz | 128/206.12 |
| 2,565,124 | 8/1951 | Durborow | 128/206.19 |
| 2,634,724 | 4/1953 | Burns | 128/206.19 |
| 2,634,725 | 4/1953 | Lo Presti | 128/206.19 |
| 3,154,073 | 10/1964 | Klinger | 128/206.12 |
| 3,333,585 | 8/1967 | Barghini et al. . | |
| 3,603,315 | 9/1971 | Becker . | |
| 3,613,678 | 10/1971 | Mayhew . | |
| 3,768,100 | 10/1973 | Colman et al. . | |
| 3,884,227 | 5/1975 | Lutz et al. . | |
| 3,971,369 | 7/1976 | Aspelin et al. | 128/206.19 |
| 4,090,510 | 5/1978 | Segersten | 128/206.12 |
| 4,095,290 | 6/1978 | O'Brien . | |
| 4,150,671 | 4/1979 | Tiger . | |
| 4,250,577 | 2/1981 | Smith . | |
| 4,269,183 | 5/1981 | Hunt . | |
| 4,300,240 | 11/1981 | Edwards . | |
| 4,384,577 | 5/1983 | Huber et al. . | |
| 4,419,993 | 12/1983 | Petersen . | |
| 4,419,994 | 12/1983 | Hilton . | |
| 4,458,679 | 7/1984 | Ward . | |
| 4,600,002 | 7/1986 | Maryyanek et al. . | |
| 4,620,537 | 11/1986 | Brown . | |
| 4,628,927 | 12/1986 | Ward | 128/206.19 |
| 4,671,268 | 6/1987 | Hunt . | |
| 4,768,235 | 9/1988 | Webster . | |
| 4,825,474 | 5/1989 | Edwards . | |
| 4,850,347 | 7/1989 | Skov . | |
| 4,856,509 | 8/1989 | Lemelson . | |
| 4,905,686 | 3/1990 | Adams . | |
| 4,941,467 | 7/1990 | Takata . | |
| 4,941,470 | 7/1990 | Hubbard et al. . | |
| 4,945,907 | 8/1990 | Tayebi . | |
| 5,025,506 | 6/1991 | Huang . | |
| 5,107,547 | 4/1992 | Scheu . | |
| 5,214,804 | 6/1993 | Carey . | |
| 5,265,280 | 11/1993 | Walsh . | |
| 5,374,458 | 12/1994 | Burgio . | |
| 5,419,318 | 5/1995 | Tayebi . | |

FOREIGN PATENT DOCUMENTS

| | | | |
|---|---|---|---|
| 2451402 | 5/1975 | Germany | 128/201.17 |
| 2451403 | 5/1975 | Germany | 128/201.17 |

*Primary Examiner*—Kimberly L. Asher
*Attorney, Agent, or Firm*—Bullwinkel Partners, Ltd.

[57] ABSTRACT

A multipurpose face mask made of supple material covers the nose, mouth, and chin with a two sided chamber held away from the entrance of the nostrils and the mouth by a rigid support attached inside the vertical front fold. This rigid support makes possible the use of a wide variety of soft materials in one or more layers, which may serve to filter dust, pollen, mold, dander, powder, and other common airborne particles, and/or to warm and humidify cold, dry air. For versatility in purpose, a disposable version may fit inside a reusable version. The cold weather version may have air holes in the outer layer. This device of supple material can be made in several sizes and rolled to fit in a pocket or purse and has an attractive, lean appearance with potential for embellishment. This invention in its many forms enhances the lives of people with respiratory disorders or professions which require respiratory protection.

17 Claims, 3 Drawing Sheets

FIG. 1
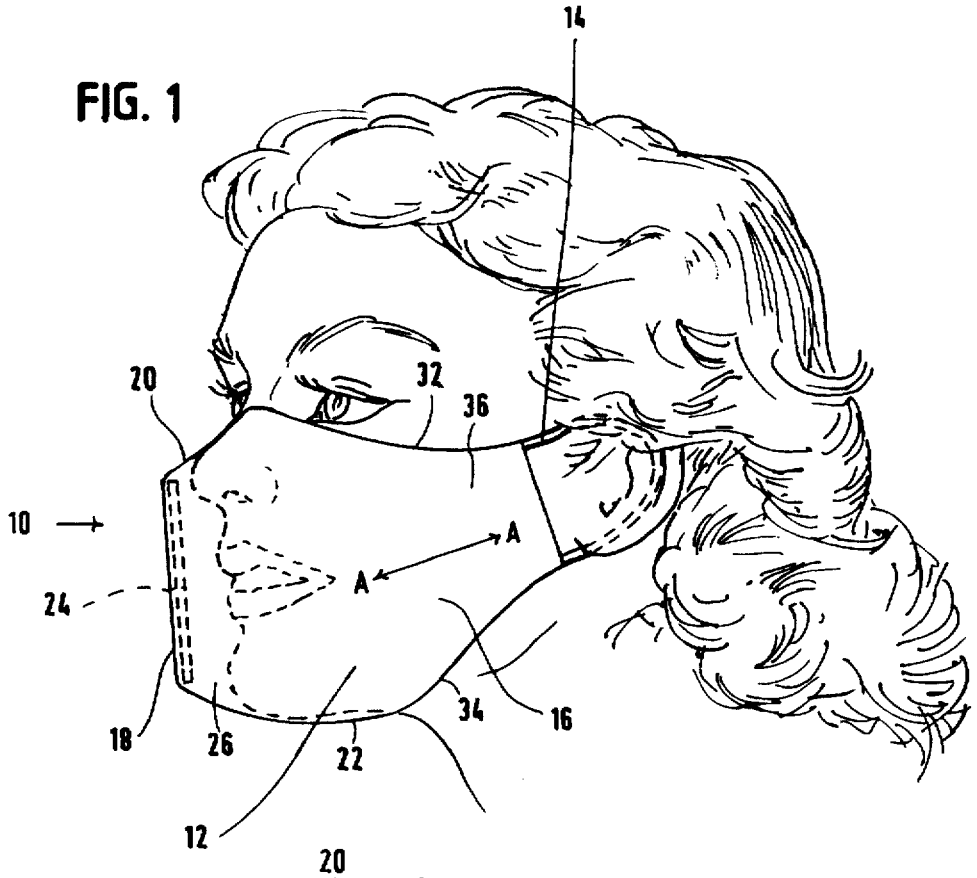
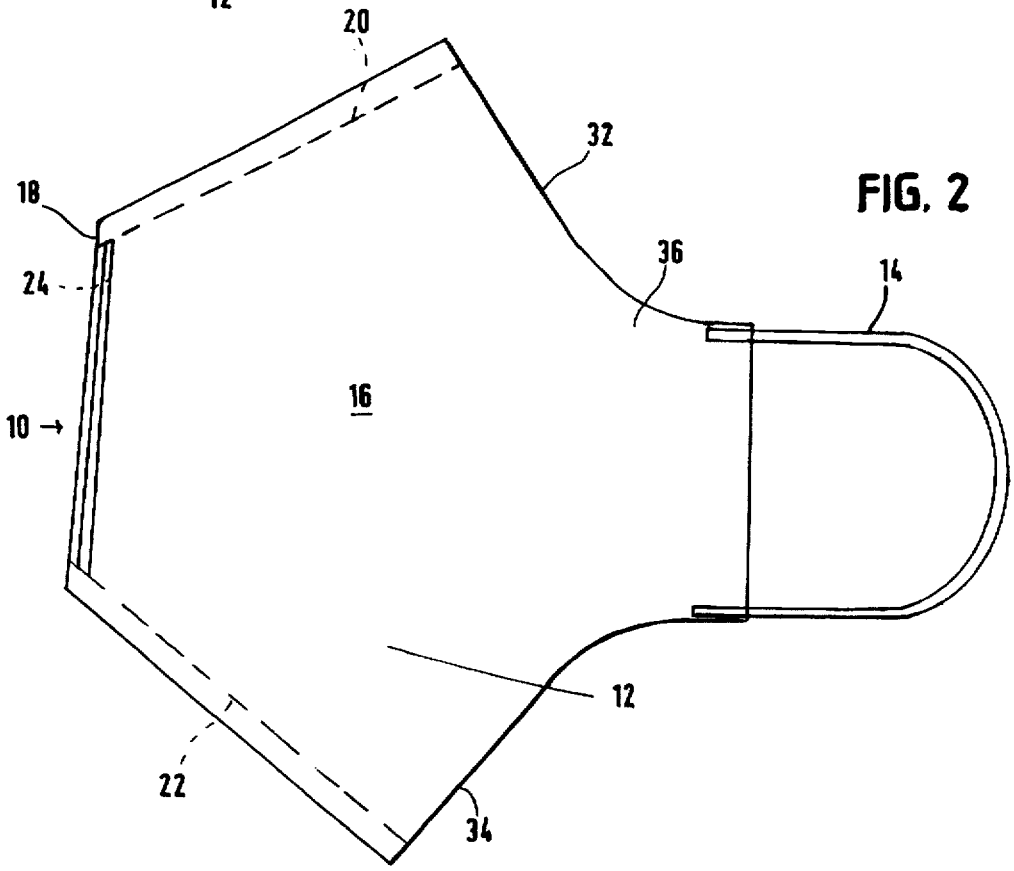
FIG. 2

FIG. 3
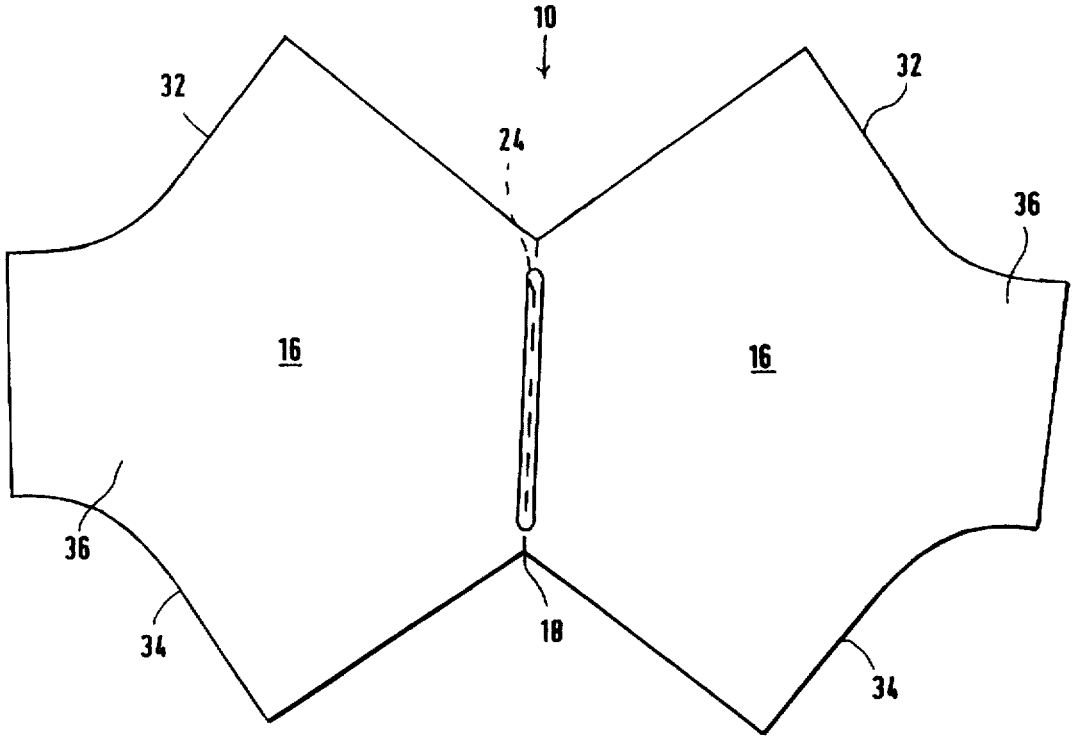
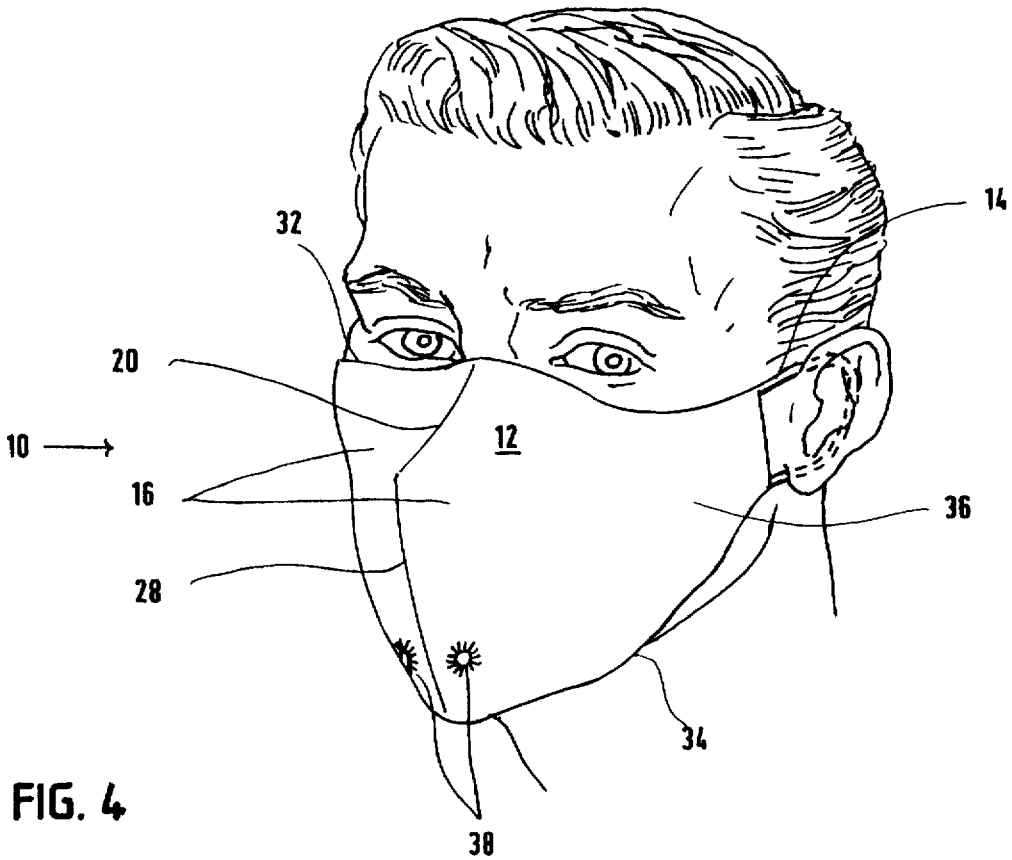
FIG. 4

MULTIPURPOSE FACE MASK THAT MAINTAINS AN AIRSPACE BETWEEN THE MASK AND THE WEARER'S FACE

BACKGROUND OF THE INVENTION

1. Field of the Invention

The present invention relates to face masks that serve to warm and humidify cold dry air and/or filter air pollutants. In particular, the present invention addresses the need for durable, washable, attractive face masks which fold flat and may be rolled to carry discreetly in a pocket or purse to use in public or private wherever needed for instant protection against elements of weather or air pollution. The construction is also appropriate for disposable masks, mass produced in any flexible filtration material for personal, industrial, or medical use. For versatility in purpose, the construction allows a disposable mask to be worn inside a durable mask.

2. Background Art

Masks covering the nose and mouth are used for two major purposes: to warm cold air and/or to filter pollutants.

A common problem in the prior art is resistance to wear unattractive masks in public. To warm cold air, scarves or masks are recommended by doctors for people with lung or heart disorders when the temperature drops below 35 degrees. This need is growing because lung disease increased one third in the decade from 1983 to 1993. Asthmatic children often are not allowed to play outside in winter and have difficulty walking to school for lack of a convenient, effective, attractive means of warming cold air. Outside activity of elderly and asthmatic adults is restricted in cold climates. People whose work requires they be outside in cold weather, for example, telephone and electrical repair people and people who exercise, also suffer from inhaling cold air. Fogging of eye glasses is a common problem with scarves and with masks currently on the market. Resistance to use of unwieldy or unbecoming masks in public endangers people with lung disorders and restricts outdoor ventures by people who need protection. A convenient, comfortable, secure, fashionable, durable, washable mask is needed to replace scarves and cumbersome or unsightly alternatives.

Patented inventions attempting to address the problem of the effect of cold air on respiration are unwieldy, impractical, often interfere with wearing eye glasses, and/or are unattractive. For example, Takata U.S. Pat. No. 4,941,467, Skov U.S. Pat. No. 4,850,347, and Barghini U.S. Pat. No. 3,333,585 all involve a rigid cup construction common today in all purpose masks currently available on the market. The rigid material construction is uncomfortable, and to fit snugly on the nose often requires a metal nose bar which interferes with glasses. The rigid construction is not convenient for storage and carrying. Cold weather masks such as O'Brien U.S. Pat. No. 4,095,290 and Edwards U.S. Pat. Nos. 4,300,240, 4,825,474 and 5,214,804 (with Carey) may warm the face, but leave the nostrils uncovered to inhale cold air. In addition, the front seam of Edwards' masks does not serve to render support to supple material.

A cold weather breathing mask by Adams, U.S. Pat. No. 4,905,686, is relatively unwieldy as it uses a power supply to heat the air and does not address the humidification problem. Webster U.S. Pat. No. 4,768,235 describes an elaborate cold weather mask and hood with a lens and air intake hose which is unwieldy for ordinary purposes. Both Hunt U.S. Pat. Nos. 4,671,268 and 4,269,183, and Brown U.S. Pat. No. 4,620,537 describe designs that are unwieldy and unattractive under common circumstances.

Three other masks, Ward U.S. Pat. No. 4,458,679, Tiger U.S. Pat. No. 4,150,671 (for cardiac patients), and Colman U.S. Pat. No. 3,768,100, are equally inconvenient for ordinary people with sensitive lungs when they go in and out of buildings and vehicles, take walks on winter days, or are around animals.

For filtering pollutants, doctors recommend that lung patients wear filtration masks when exposed to particulate matter such as dust, pollen, dander, or mold. Numerous uncomfortable, disposable filtration masks which cover the nose and mouth are available to serve this purpose.

Conventional disposable, firm construction cup shaped filter masks having metal nose grips fog glasses, are uncomfortable against the face, and are noticeably unattractive. Most recently, Tayebi U.S. Pat. No. 5,419,318 addressed the problems of cup shaped masks that slip under the chin and interfere with glasses. The solution disclosed by Tayebi includes a cumbersome chin stop. Other conventional masks which make use of supple filtration material employ rigid frames which do not conform to facial differences and are uncomfortable. For example, plastic frames become cold and hard against the face in winter.

A disposable respirator disclosed in Maryyanek et al. U.S. Pat. No. 4,600,002, intended for industrial protection against noxious environments, is multiple ply, folds flat, and has a vertical inverted seam reinforced with a flexible strip. This exemplary flat fold device addresses problems of the rigid cup construction and reusable frame supported structures. It is light, comfortable, offers minimal resistance to breathing, and is convenient to store. However, this construction still requires the attachment of a metal nose bar for fitting over the nose and for public use would be unattractive. The head bands are inconvenient to put on and interfere with hairdos.

In U.S. Pat. No. 5,025,506, Huang addresses the problem of the fit over the nose. However, the mask does not have an air space but rests against the nose and mouth.

Walsh U.S. Pat. No. 5,265,280 describes a facial screen with connecting elastic that is meant to prevent ingestion of insects by the wearer during outside exercising. Walsh's mask covers only the mouth, leaving the nose open to inhaling small insects.

Currently available all-purpose, rigid cup construction masks effective in reducing inhalation of dust, dander, mold, and particulate pollutants in hot weather increase sweating on the forehead and around the eyes as well as within the mask if one is doing housework or exercising. Medical personnel wear masks of the rigid cup construction or of supple pleated material, both of which are inappropriate for public use.

The present invention is an improvement which avoids inadequacies of the prior art in numerous kinds of masks. The combination of the vertical rigid support with supple or soft material providing an air space between the mask and the user and the snugness of fit of the mask provides advantages over currently available masks. The construction of the mask promotes a multitude of variation in materials heretofore not possible to use for face masks covering both nose and mouth without rigid construction or frames.

OBJECTS OF THE INVENTION

It is an object of the present invention to provide an improved face mask that warms and humidifies cold air and/or filters air pollutants.

It is a further object of this invention to provide a mask that maintains an air space between the mask and the face of the user.

It is a further object of this invention to provide a mask which not only has rigid construction with an air space but also folds flat and may be rolled to carry conveniently in a pocket or purse.

It is a further object of this invention to provide a mask that fits both snugly and comfortably.

It is a further object of this invention to provide a cold weather mask that is attractive, easily washed and dried, and will not interfere with wearing eye glasses.

It is a further object of this invention to provide a cold weather mask that minimizes fogging of eye glasses.

It is a further object of this invention to provide a cold weather mask that filters gross particulate pollutants.

It is a further object of this invention to provide a utility mask available in a variety of fashionable fabrics and colors so those who need protection will want to wear it.

It is a further object of this invention to provide a cold weather mask which may be embellished so children as well as teenagers and adults will want to wear it.

SUMMARY OF THE INVENTION

In one form of the present invention the objects are realized by a mask which covers the nose and mouth of the wearer and is comprised of a two sided chamber with a top seam, a bottom seam, a vertical front fold connecting the two sides of the chamber, and a vertical front seam forming a sleeve between the vertical front fold and vertical front seam. The top seam extends along the ridge of the nose of the wearer to beyond the tip of the nose of the wearer. The bottom seam extends from under the chin of the wearer to the vertical front fold. The vertical front fold is positioned between the top seam and the bottom seam and is displaced away from the nose and chin, thus providing an air space. The sides of the chamber may extend along the cheeks toward the ears. Means for fastening the mask to the head of the wearer are attached to the outer edge of the cheek extensions of the chamber. The preferred embodiment contains a rigid support inserted inside the sleeve formed between the vertical front fold and vertical front seam.

In a further embodiment, the above objects are realized by a mask which covers the nose and mouth of the wearer and is comprised of a two sided chamber with a top seam, a bottom seam and a vertical front fold connecting the two sides of the chamber. The top seam extends along the ridge of the nose of the wearer to beyond the tip of the nose of the wearer. The bottom seam extends from under the chin of the wearer to the vertical front fold positioned between the top seam and the bottom seam. Means for fastening the mask to the head of the wearer are attached to the chamber which may or may not have cheek extensions toward the ears. In this disposable embodiment the rigid support adheres to the inside of the vertical front fold of the chamber. This disposable embodiment may also be worn inside the durable embodiment.

BRIEF DESCRIPTION OF THE DRAWINGS

FIG. 1 is a perspective view of the present invention showing the multipurpose face mask with a rigid support attached to the inside of the vertical front fold.

FIG. 2 is an elevational, inside-out view of the multipurpose face mask of FIG. 1.

FIG. 3 is a flat, face-side, pattern view of the multipurpose face mask of FIG. 1, shown without attachment straps.

FIG. 4 is a perspective view of a second embodiment of the present invention, showing a cold weather face mask having reinforced eyelet air holes.

DETAILED DESCRIPTION OF THE DRAWINGS

Figure 5:
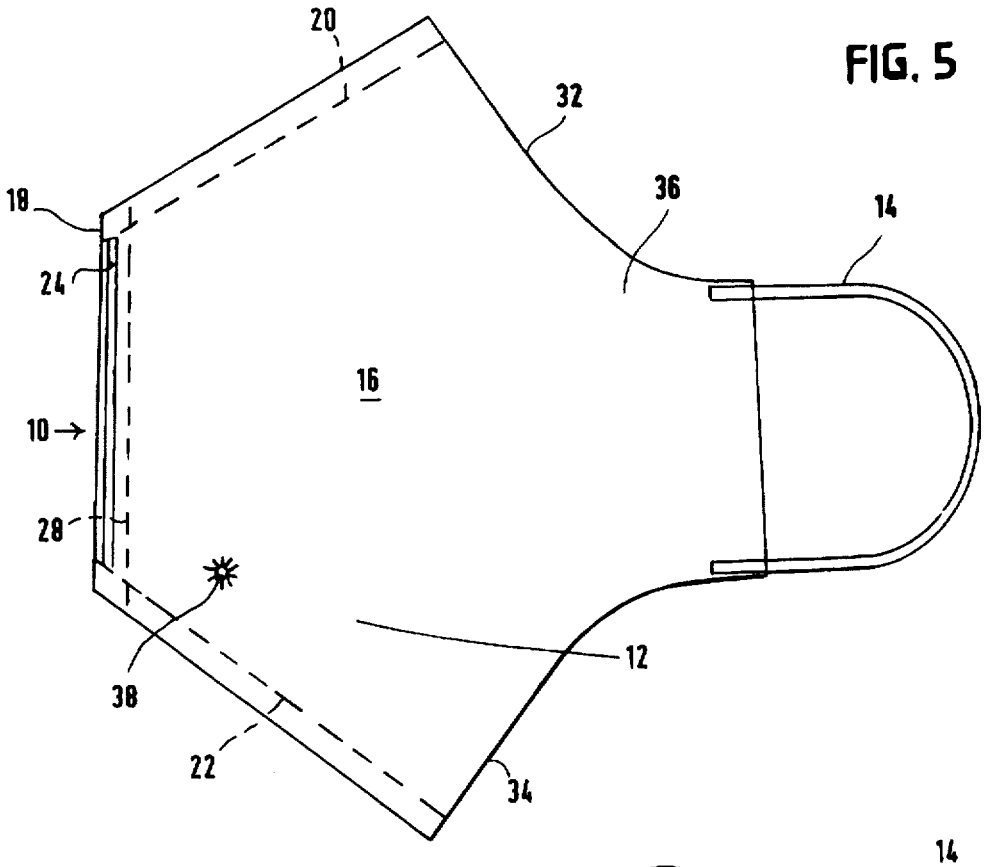
FIG. 5 is an elevational, inside-out view of the mask of FIG. 4 showing a rigid support inserted in the sleeve between the vertical front fold and vertical front seam.

Turning to the drawings, FIG. 1 shows one embodiment of the multipurpose face mask 10 of the present invention. The mask 10 comprises a face covering portion or chamber 12 and straps 14 for fastening the mask 10 to the head of the wearer.

As shown in FIG. 1, the chamber 12 comprises two symmetrical sides 16, a left side and a right side. The two sides of the chamber 12 are connected at a vertical front fold 18. Generally, the two sides 16 are sewn together, creating a top seam 20 and a bottom seam 22.

As shown in FIGS. 1, 2, and 3, the vertical front fold 18 is reinforced with a rigid support 24 attached to the vertical front fold 18. The rigid support 24 can be attached to the vertical front fold 18 by an adhesive or other suitable means. The rigid support 24 may be formed of plastic or any suitable material to prevent collapse of the mask 10 and maintain a streamline appearance. Importantly, the vertical front fold 18 reinforced with the rigid support 24 maintains the air space 26 between the mask 10 and the wearer.

It is contemplated that this first embodiment of the mask might be used for disposable masks worn in medical, surgical or industrial settings. Engaging this first embodiment of the mask would be most convenient for mass production of these disposable masks.

The Preferred Embodiment

Figure 6:
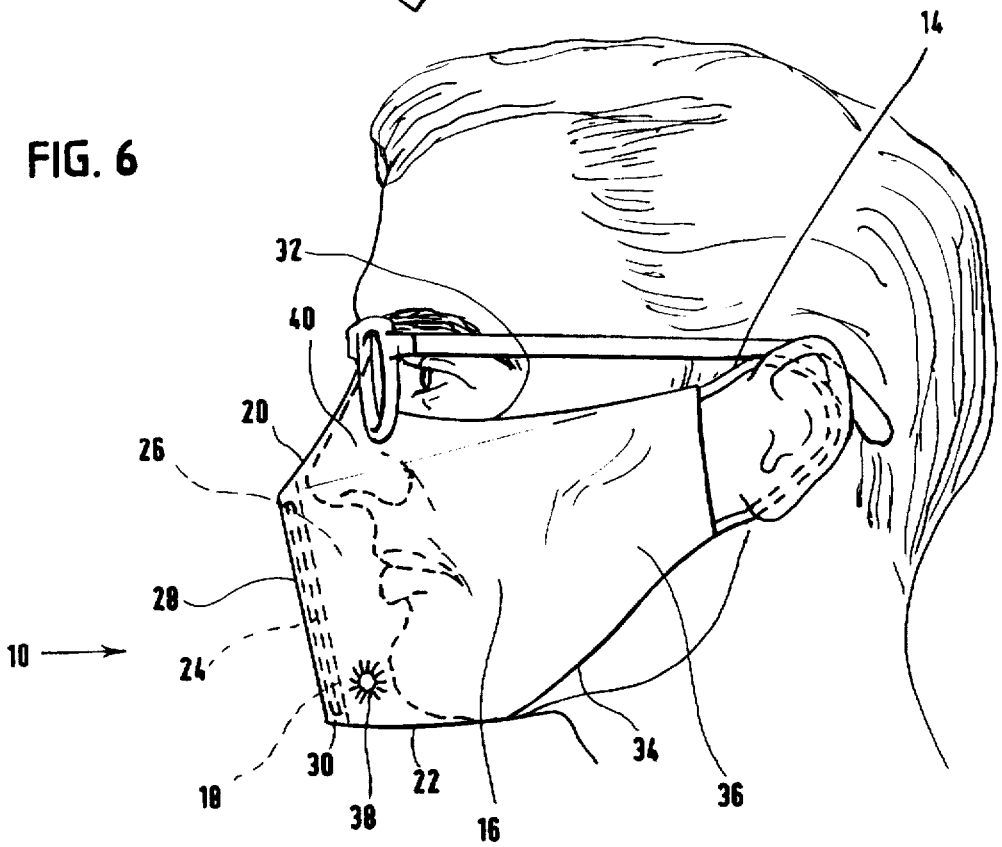
FIG. 6 is a perspective view of the mask of FIG. 4 showing how the mask accommodates eye glasses.

A second embodiment of the present invention is shown in FIGS. 4, 5, and 6. In this second embodiment, the chamber 12 has a vertical front seam 28 which, with vertical front fold 18, forms a sleeve 30 between the vertical front fold 18 and the vertical front seam 28. The rigid support 24 is inserted into the sleeve to reinforce the vertical front fold 18 and the vertical front seam 28, as previously described above when the rigid support 24 is attached directly to the vertical front fold 18 in the first embodiment. The vertical front fold 18 and vertical front seam 28 reinforced with the rigid support 24 maintains an air space 26 between the mask 10 and the wearer.

The mask 10 with the two sided chamber 12 with the rigid support 24 and air space 26, with or without the vertical front seam 28, fits snugly and comfortably over the nose without the metal "nose bar" found in some conventional masks. This construction also allows the mask to fold flat and to be rolled up and be carried conveniently in a pocket or purse to use in public or private wherever needed.

Material for the chamber 12 may or may not have a stretch characteristic. Material with stretch will have a crosswise grain and a lengthwise grain. The crosswise grain displays the greatest stretch while the lengthwise grain displays the least stretch. Too much stretch of the material in the horizontal direction between the nose and ears of the wearer pulls the mask out of shape and loosens the fit. In order to retain the shape and fit properly, the crosswise grain should, therefore, be positioned vertically, in line with or parallel with the vertical front fold 18, and the lengthwise grain should be positioned horizontally, perpendicular to the vertical front fold 18. The lengthwise grain is shown in FIG. 1 by arrow A—A.

For use in the cold weather, the chamber 12 may be made of polyester fleece with silk lining which warms and filters air, or any suitable material or fabric that can be comfortably worn on the face. The supple material used for the chamber 12 rolls or folds and can be conveniently stowed in a pocket or purse and available to wear when needed, thereby overcoming the inconveniences of prior masks. As shown in FIGS. 4, 5 and 6, two reinforced eyelet air holes 38 may be included in the chamber 12, one on either side to allow air to enter and exit at a distance from the nostrils so that the exhaling air warms and humidifies the fresh incoming air.

Each side 16 of the chamber has a top edge 32 and a bottom edge 34. The top edges 32 are configured to fit snugly against the face of the wearer. In addition, as shown in FIGS. 1–6, each side 16 of the chamber may have an extended cheek cover 36. The extended cheek covers 36 not only provide additional warmth for the face in the cold weather but also provide a snugness of fit for the mask.

Currently available masks often interfere with eye glasses. However, the snugness of the fit of the mask provided by the top edges 32 of the chamber and the extended cheek covers 36 allow eye glasses to be worn comfortably with the mask. As shown in FIG. 6, eye glasses can sit over the top edges 32 of the chamber. Another common problem with currently available masks is fogging of the eye glasses during cold weather. However, the snugness of the fit of the mask also minimizes fogging of eye glasses, forcing the exhaled air to escape in a downward fashion through the reinforced eyelet air holes 38 instead of upward toward the eyeglasses where the warm moist air can causes fogging.

The air space 26 provides advantages for the mask not found in other currently available masks. The air space 26 helps to provide additional comfort to the wearer of the mask since the material comprising the chamber 12 is not in direct contact with the nostrils or the mouth of the wearer. The air space 26 not only keeps the material of the chamber away from the nostrils during inhalation but also facilitates talking while wearing the mask. The air space 26 also provides an area within which cold air can be warmed prior to entering the lungs.

The multipurpose mask 10 may also be used for filtration of air pollution and particulates. The chamber 12 of filtration versions of the multipurpose mask may be made of any supple, suitable material appropriate to filter out substances which assault the lungs. Contemplated materials for the chamber for any use of the mask include, without limitation, woven fabric, nonwoven fabric, fleece, cotton, wool, lycra, silk, three layered surgical mask material, and supple plastic screen material.

In addition, for some people it may be advantageous for the wearer to be able to rinse the mask with water, roll it in a towel, to blot excess water and wear the mask damp for humidification in heated dry rooms.

For some uses, it may be desirable to have the chamber 12 made of more than one layer of material. In these multiple layered masks, the multiple layers can be attached together by lamination or stitching the layers of material together. Stitching the layers together serves to keep the layer closest to the face of the wearer away from the nostrils and mouth during inhalation.

Moreover, it is also contemplated that ornamental embellishments may be sewn, drawn, painted or printed on the mask such as likeness of an animal, clown or other suitable fantasy figure or a message such as "GO AHEAD SMOKE" or "OZONE ALERT" which may serve to enhance the wearer's desire to wear the mask. These embellishments along with possible matching or contrasting mittens, scarfs or headbands may encourage non-asthmatic children to want such garments and improve the desire of asthmatic children to comply with protection against cold which could trigger an asthma episode. Small replica masks for dolls and stuffed animals may also encourage youngsters to wear masks. It is also contemplated that the chamber may be part of a helmet or other head gear equipment, such as neck or shoulder gear for warmth or costume design.

Numerous convenient means for fastening a mask to the head of the wearer are contemplated. In the embodiments shown in FIGS. 1–2, and 4–5, permanently attached ear loops or straps 14 of elastic or other suitable cord material of adjustable length make the mask easy to put on and to fit snugly without interfering with hairdo, glasses, goggles, or hat. Other contemplated fastening means include a permanently attached elastic strap or cord of suitable material that encircles the head below or above the ears and is easily adjusted by means of a cord stop.

An optional feature of the present invention is an antifogging, wind resistant shield 40, shown in FIG. 6. This antifogging, wind resistant shield 40 can be stitched or attached by any other suitable means to the chamber 12 positioned from about the top edge 32 of the chamber and extending to about the level of the vertical front fold 18. The antifogging, wind resistant shield 40 can be made of nylon or any suitable wind resistant material such as wind breaker material. This optional feature, together with the snugness of the fit of the mask provided by the top edges 32, minimizes fogging of eye glasses. With the antifogging, wind resistant shield 40 feature, warm moist exhaled air is forced to escape from the mask in a downward fashion instead of in an upward fashion to fog the eye glasses.

Other embodiments of the invention are contemplated which do not depart from the scope of the inventions claimed. While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

I claim as my invention:

1. A multipurpose face mask for covering the nose and mouth of a wearer comprising:

a chamber having two sides connected by a top seam, a bottom seam and a vertical front fold, the top seam extending over the ridge of the nose of the wearer to beyond the tip of the nose of the wearer, the bottom seam extending from in front of the chin of the wearer towards the neck of the wearer, the vertical front fold positioned between the top seam and the bottom seam;

means for fastening the mask to the head of the wearer; and means for holding the vertical front fold away from a wearer's nose and mouth, said means comprising a rigid support attached to the vertical front fold and extending substantially along its entire length.

2. The device according to claim 1 wherein the rigid support is attached to the vertical front fold by an adhesive.

3. The device according to claim 1 wherein the chamber is formed of a stretchy, malleable material having a lengthwise grain and a crosswise grain, the vertical front fold being substantially in line with the crosswise grain and substantially perpendicular to the lengthwise grain of the material.

4. The device according to claim 3 wherein the material is selected from the group consisting of woven fabrics and nonwoven fabrics.

5. The device according to claim 1 wherein each side of the chamber has a top edge and a bottom edge, each top edge configured to fit the mask snugly against the wearer's face.

6. The device according to claim 1 wherein each side of the chamber has an extended cheek cover.

7. The device according to claim 1 wherein the chamber is formed of multiple layers of material.

8. The device according to claim 7 wherein at least one layer of material is a filter.

9. The device according to claim 7 wherein at least two layers of material are attached to each other by stitching.

10. The device according to claim 1 wherein the chamber has at least one reinforced eyelet air hole.

11. The device according to claim 1 wherein each side of the chamber has at least one reinforced eyelet air hole.

12. The device according to claim 1 wherein the material can be moistened prior to use by the wearer.

13. The device according to claim 1 wherein an ornamental embellishment is attached to the mask.

14. The device according to claim 1 wherein the means for fastening the mask to the head of the wearer comprise adjustable ear loops.

15. A multipurpose face mask for covering a nose and mouth of a wearer comprising:

a chamber having a top edge two sides connected by a top seam, a bottom seam, a vertical front fold and a vertical front seam substantially parallel to the vertical front fold so as to form a sleeve, the top seam extending over the ridge of the nose of the wearer to beyond the tip of the nose of the wearer, the bottom seam extending from in front of the chin of the wearer towards the neck of the wearer, the vertical front fold positioned between the top seam and the bottom seam;

means for fastening the mask to the head of the wearer; and a rigid support located in the sleeve.

16. The device according to claim 15 wherein the chamber is formed of a stretchy, malleable material having a lengthwise grain and a crosswise grain of greater stretching ability than the lengthwise grain, the vertical front fold being substantially in line with the crosswise grain and substantially perpendicular to the lengthwise grain of the material.

17. The device according to claim 15 further comprising an antifogging, wind resistant shield attached to the chamber and extending from about the top edge to about the level of the vertical front fold.

* * * * *